United States Patent [19]

Björhn

[11] Patent Number: 4,662,632

[45] Date of Patent: May 5, 1987

[54] STRING TENSIONING DEVICE FOR USE ON RACKETS FOR BALL GAMES

[76] Inventor: Gunnar Björhn, Furusundsgatan 7, 115 37 Stockholm, Sweden

[21] Appl. No.: 893,469

[22] PCT Filed: Feb. 16, 1984

[86] PCT No.: PCT/SE84/00056

§ 371 Date: Oct. 18, 1984

§ 102(e) Date: Oct. 18, 1984

[87] PCT Pub. No.: WO84/03221

PCT Pub. Date: Aug. 30, 1984

Related U.S. Application Data

[63] Continuation of Ser. No. 672,257, Oct. 18, 1984, abandoned.

[30] Foreign Application Priority Data

Feb. 21, 1983 [SE] Sweden ..... 8300936

[51] Int. Cl.[4] ..... A63B 51/12

[52] U.S. Cl. ..... 273/73 D; 24/71.1; 273/73 E

[58] Field of Search ..... 273/73 R, 73 D, 73 A, 273/73 B, 67 R; 211/119.5; 254/231; 24/71.1

[56] References Cited

U.S. PATENT DOCUMENTS

| | | | |
|---|---|---|---|
| 284,969 | 9/1883 | McIntosh | 24/71.1 |
| 1,957,367 | 5/1934 | Snydan | 24/71.1 |
| 2,049,074 | 7/1936 | Mott | 24/71.1 |
| 2,336,818 | 12/1943 | Topinka | 24/71.1 |
| 2,444,743 | 9/1946 | Melidoni | 24/71.1 |
| 2,497,007 | 2/1950 | Melidoni | 24/71.1 |
| 3,183,565 | 5/1965 | Schwarz | 24/71.1 |

FOREIGN PATENT DOCUMENTS

| | | | |
|---|---|---|---|
| 855446 | 2/1940 | France | 273/73 D |
| 902891 | 9/1945 | France | 24/71.1 |

*Primary Examiner*—Richard C. Pinkham
*Assistant Examiner*—Matthew L. Schneider
*Attorney, Agent, or Firm*—Nies, Webner, Kurz & Bergert

[57] ABSTRACT

Device for the adjustment of ball game rackets which is intended to bring about the desired tension in a racket surface through adjustment of the tension in the strings and which consists of a triangular holder provided with a groove for the string and with an adjustment screw whose tip is directed towards the apex of the holder, the screw tightening a string to the desired result by pressure.

4 Claims, 7 Drawing Figures

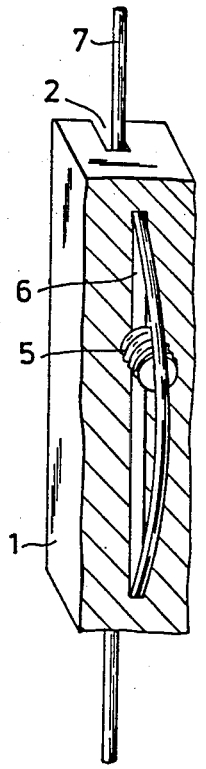
Fig. 3
Fig. 4
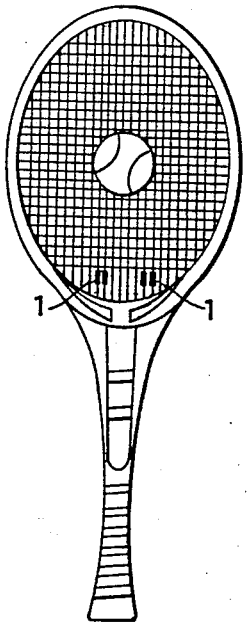

Fig 5
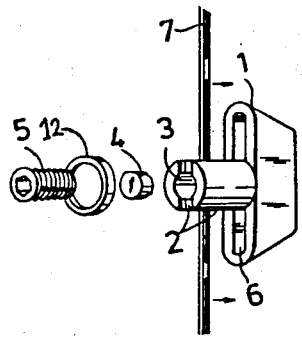
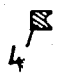
Fig 6
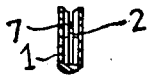
Fig 7

STRING TENSIONING DEVICE FOR USE ON RACKETS FOR BALL GAMES

BACKGROUND OF THE INVENTION

This application is a continuation of application Ser. No. 672,257, filed Oct. 10, 1984, now abandoned.

The present invention relates to a device for adjusting preferably ball-play rackets and badminton rackets. The invention is intended to produce desired tension in the strings of the racket surface, by adjusting the strings by stretching or slackening respective strings.

Ball games played with the aid of rackets have long formed part of sporting activities. Tennis is one ball game which has become increasingly popular over the past years. Participation in the sport of tennis, however, is expensive. A large part of this expense is incurred by the high cost of the conventional equipment required. The strings of a tennis racket progressively lose their tension, and consequently tennis rackets require re-stringing with new strings, at high cost, in order to regain the desired racket tension. This problem of high costs has culminated in the concept of effectively re-tensioning a racket with the aid of a simple device, at a fraction of the earlier costs.

Only a few devices which can be attached directly to racket strings for the purpose of tensioning the same are known to the art. None of these known devices, however, enable each string to be tensionsed individually, as is required when the extent to which the strings become stretched varies from one string to another. Neither is it possible with such devices to tension the strings alternately in opposite directions relative to the plane of the racket in the same manner as one racket string alternately tensions the strings running perpendicular thereto.

SUMMARY OF THE INVENTION

An object of the present invention is to overcome these disadvantages, by providing a device with which each racket string is tensionsed individually to the strength required, until all the strings are of uniform tension and resilience. This effect is achieved quite independently of whether the strings are initially uniformly tensioned or not when the player desires to adjust the string tension from the beginning. Another important advantage afforded by the present invention is that adjustment of the strings can be effected in an inward or an outward direction, depending upon the position of the string in relation to the undermost and nearest cross-string. As will be understood, the strings can also be tensioned laterally, in the same or different directions.

The present invention thus refers to a device for adjusting strings in preferably ball-play rackets and badminton rackets intended to produce a desired tension in a racket surface by adjusting the hardness of the string tension, and is characterized in that the device comprises a member provided with a groove adapted to receive a string, a first and second abutment spaced apart along the groove and adapted for engaging the string and a hole located intermediate the space abutments, which hole is located in the groove and extending perpendicular to a line through said two abutments, said hole being intended to cooperate with a third adjustable abutment, whereby a string is intended to be tensioned by displacing the part of the string lying between said first and second abutments by means of the third adjustable abutment to a position outside said line through said first and second abutment.

The novel features of the invention are set forth in the following claims, and embodiments of the invention are described below with reference to the accompanying drawings. It will be understood that the invention is not restricted to these embodiments, and that modifications can be made within the scope of the following claims.

BRIEF DESCRIPTION OF THE DRAWING

In the drawings:

FIG. 3 is a cross sectional view of the device according to the invention;

FIG. 4 shows a tennis racket in a small scale provided with four devices according to the present invention;

FIG. 5 shows an exploaded view of the device according to another embodiment of the invention;

FIG. 6 shows a cross sectional view of a plug; and

FIG. 7 shows a cross sectional view of a member accommodating a string.

GENERAL DESCRIPTION

Figure 1:
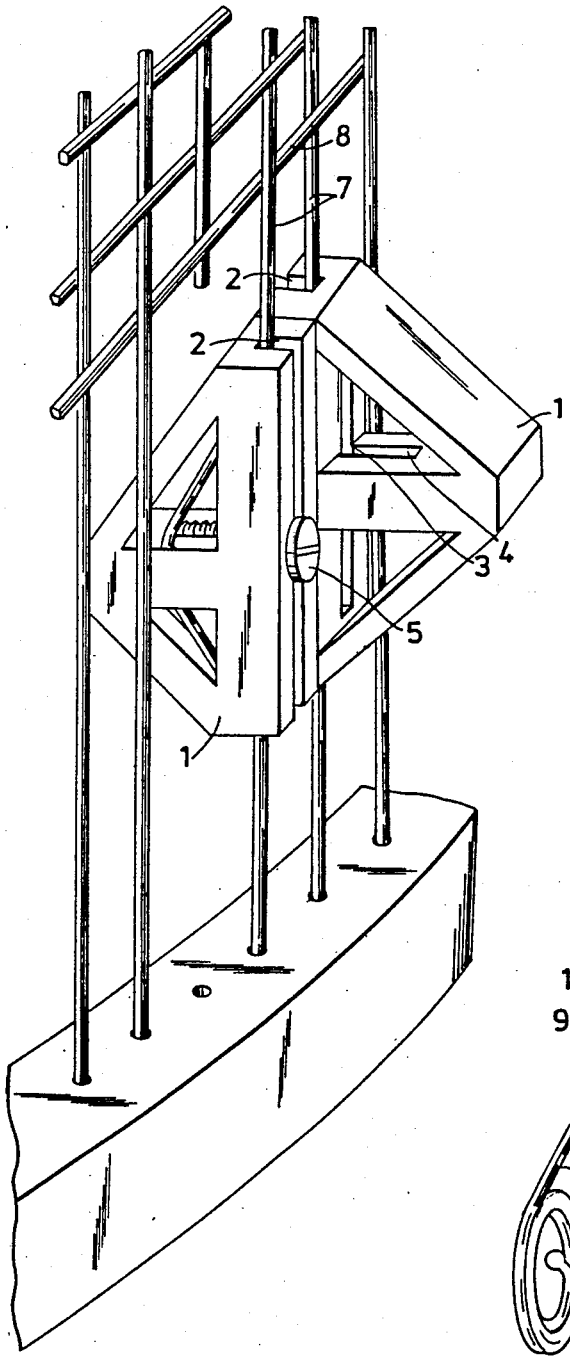
FIG. 1 illustrates in a perspective and enlarged scale a device according to the invention.

FIG. 1 illustrates in perspective and enlarged scale a string-tensioning device according to the invention. In FIG. 1 this device has been duplicated in order to show more clearly the position of the device against a string when the string is acted upon by the device in a stretched state.

Further, FIG. 1 illustrates the manner in which the device is used when wishing to tighten two mutually adjacent strings in opposite directions relative to the plane of the racket. This is made possible by an important feature of the device, in which the strings are tensioned harder or more loosely in mutually different directions relative to the plane of the racket in dependence upon the position of the strings 7 in relation to the lower-most and nearest cross-string 8. Thus, when adjusting the tension of two strings 7 lying side-by-side, there is used two devices placed in opposite, reversed working positions.

Figure 2:
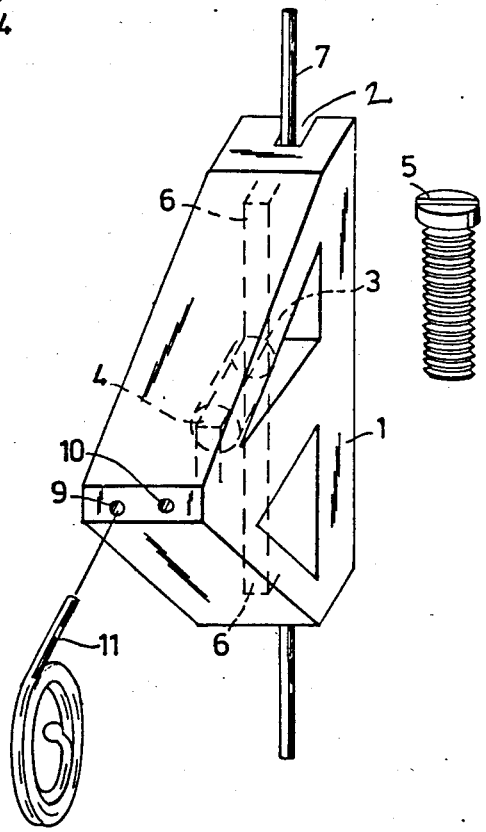
FIG. 2 shows a device according to the invention seen obliquely from the front and having, according to a modified embodiment, holes in the front.

FIG. 2 is a perspective view of the device according to the invention, seen obliquely from the front. The device is shown resting on a racket string 7 prior to screwing adjuster screw 5 into the member 1 behind the string and causing the same to bow and stretch. By way of an alternative, there is also shown a pull or tug cord 11, which can be used in certain instances for adjusting the tension of a string, by threading the pull-cord into the left-hand hole 9 in front of the member 1, passing the cord around the string from behind, and threading the cord through the right-hand hole 10 in the front of the member 1, where a tension force is applied to tighten the string to the desired tension. The pull-cord is then secured, for example by tying a knot.

FIG. 3, is a cross-sectional view of the device according to the invention, showing a device obliquely from the front. This view illustrates clearly a guide slot, where the string is forced forwards or backwards by an adjuster screw when adjusting the string tension with the aid thereof.

FIG. 4 shows a tennis racket in a small scale, and illustrates one example of how the devices can be attached to the racket. In this case the tension is distributed just as much outwards, seen in relation to the devices, as the tension is distributed in the two centermost, longitudinally extending strings to which no devices have been attached. In this way, the tension is increased in the centermost strings, when the tension in the strings to which devices have been attached is distributed across the whole surface of the racket as a ball is struck. That is to say, the tension of the four strings carrying respective devices by an amount corresponding to the extent to which the tension in the remaining strings increases when the tension is distributed across the racket surface.

According to the invention the device comprises a triangular member 1 which has formed centrally in the rear side thereof an elongated groove 2 intended to be placed either behind or in front of a string whose tension requires adjustment. The member 1 is provided centrally of the shear side, adjacent the groove 2, with a hole or bore 3 which extends towards the apex of the triangular member 1, and with continuing channel 4 intended as guide means for the outer end of the adjuster screw 5. In direct connection with the string-accommodating groove 2 a guide slot 6 may be arranged (FIG. 3), which extends through the center, longitudinally of the body of the member 1.

When, for example, a number of the longitudinally extending strings of a racket have become slack, due to being used over a longer period of time, and subsequently require re-tensioning and adjusting, such re-tensioning and adjustment is effected with the aid of a device according to the invention in the following manner.

The member 1 is placed beneath an overlying string 7, so that the string 7 rests in the string-accommodating groove 2. The adjuster screw 5 is then screwed into the hole 3 until the tip of the screw touches the string 7. The screw is then screwed in a few more turns, until the string slides into the guide slot 6 in a direction towards the apex of the member 1. Stretching of the string 7 has therewith commenced and the screw 5 is then turned until the string obtains the desired tension. Adjacent, mutually parallel strings are stretched in the same manner as the aforesaid string, but with the position of the member 1 on the string reversed, so that the string groove 2 in the member 1 lies behind the string. Other strings also in need of tensioning, or requiring to be slackened, are adjusted in a similar manner with the aid of further devices. As a result hereof the individual strings are adjusted to the desired tension with the tension in the correct direction in accordance with the position of the string in the racket. When adjusting the longitudinally extending strings, the devices according to the invention are placed in the locations illustrated in FIG. 4, adjacent the handle of the racket.

Referring to FIG. 5 the member comprises a slit 6,2 which extends through an axially outwardly projecting tube from the holder. The adjustment screw 5 is intended to cooperate with the hole 3 in the axially outwardly projectng tube. Preferably a plug 4 is positioned in front of the screw, to avoid a direct contact between the tip of the screw and the string 7. In FIG. 6 a cross sectional view of the plug 4 is shown. In FIG. 7 a cross sectional view of the member 1 according to FIG. 5 is shown.

Before the screw 5 is inserted in the member but after the string 7 has been positioned in the slit 2, a ring 12 is positioned around the lower part of the outwardly projecting tube, in order to avoid that the two halves are displaced away from each other to such an extent that the screw looses its grip relative to the inner walls of the outwardly projecting tube.

When string tension is adjusted with the aid of pull cord 11, the cord is threaded into the hole 9 and passed around the back of the string 7 and out through the hole 10, where the cord is tensioned so as to obtain the correct tension in the string, whereafter the cord is secured, with the use of a knot or the like. If a reduced tension is desired, the cord is slackened instead. The use of a pull cord can also be applied to reduce the pressure in the screw, when it is desired to place the strings under very high tension, as for example, when playing with balls which have become very soft with use, or when the player wishes, for some reason or other, to play with a heavily tensioned racket.

What is claimed and is desired to be secured by Letters Patent is:

1. A device for adjusting the tension in strings on a game racket comprising: a unitary member provided with a holder portion including an integral axially projecting diametrically split tubular portion extending from a central part of said holder portion and terminating at a terminal end, said holder portion including, between its ends, a slit which intersects and is planar with the diametrical split in said tubular portion and together therewith constitutes a groove adapted to receive a string of a racket, a first abutment and a second abutment on said holder portion at respective ends of said slit and adapted for engaging the racket string disposed in said groove, said tubular portion providing a split hole being located intermediate the spaced abutments and extending into said holder slit so that the diametrical split is coextensive with said slit and the tubular portion is perpendicular to a line through said two abutments; a ring member adapted to fit snug over the terminal end of said tubular portion so that a racket string in said groove will be confined therein and to prevent said split portions of said tubular portion from spreading apart; a third adjustable abutment means intended to adjustably cooperate in the split hole of said tubular portion with said ring member disposed on said tubular portion, whereby a racket string disposed in said groove is intended to be engaged by said third abutment means and tensioned by displacing, into said holder slit, the portion of the racket string lying between said first and second abutments by means of adjusting said third adjustable abutment means to a position into said unitary member beyond the line through said first and second abutments.

2. A device as defined in claim 1, wherein said third adjustable abutment means comprises: a screw adapted to be threaded into said split hole in the tubular member; and means at the front end of said screw intended to engage and abut the string portion located in said groove.

3. A device as defined in claim 2, wherein said means at the front end of said screw is the front end face of said screw.

4. A device as defined in claim 2, wherein said means at the front end of said screw is a plug adapted to be disposed in said split hole against the racket string and engaged by the front end of said screw.

* * * * *

UNITED STATES PATENT AND TRADEMARK OFFICE

CERTIFICATE OF CORRECTION

PATENT NO. : 4,662,632

DATED : May 5, 1987

INVENTOR(S) : GUNNAR BJORHN

It is certified that error appears in the above-identified patent and that said Letters Patent is hereby corrected as shown below:

Column 1, line 7, change "Oct. 10, 1984" to --Oct. 18, 1984--.

Signed and Sealed this

Twenty-fifth Day of August, 1987

*Attest:*

DONALD J. QUIGG

*Attesting Officer*

*Commissioner of Patents and Trademarks*